US007654526B2

(12) United States Patent
Sudo et al.

(10) Patent No.: US 7,654,526 B2
(45) Date of Patent: Feb. 2, 2010

(54) CORRECTION METHOD OF TRANSPORT AMOUNT AND MEDIUM TRANSPORT APPARATUS

(75) Inventors: Naoki Sudo, Matsumoto (JP); Hirokazu Nunokawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 112 days.

(21) Appl. No.: 11/854,752

(22) Filed: Sep. 13, 2007

(65) Prior Publication Data

US 2008/0073832 A1 Mar. 27, 2008

(30) Foreign Application Priority Data

Sep. 13, 2006 (JP) ..... 2006-247892

(51) Int. Cl.
*B65H 5/12* (2006.01)
*B41J 11/00* (2006.01)

(52) U.S. Cl. ..... 271/266; 271/265.01; 271/258.01; 400/582

(58) Field of Classification Search ..... 271/265.01, 271/266, 258.01, 259; 400/582
See application file for complete search history.

(56) References Cited

U.S. PATENT DOCUMENTS 5,131,770 A * 7/1992 Kanemitsu ..... 400/568
5,209,589 A * 5/1993 Bliss ..... 400/568
6,101,426 A * 8/2000 Kimura et al. ..... 700/219
6,116,795 A * 9/2000 Ogasawara ..... 400/582
6,364,549 B1 * 4/2002 Lesniak et al. ..... 400/74
6,428,224 B1 * 8/2002 Askren et al. ..... 400/582
6,650,077 B1 * 11/2003 Marra et al. ..... 318/560
6,827,421 B2 * 12/2004 Nunokawa et al. ..... 347/19
7,397,525 B2 * 7/2008 Tago et al. ..... 349/119

FOREIGN PATENT DOCUMENTS

JP 05-96796 A 4/1993
JP 2000-006478 A 1/2000
JP 2002-310613 A 10/2002

* cited by examiner

*Primary Examiner*—Patrick H Mackey
*Assistant Examiner*—Luis Gonzalez
(74) *Attorney, Agent, or Firm*—Sughrue Mion, PLLC

(57) ABSTRACT

A correction method of a transport amount includes: detecting a movement amount of a medium while transporting the medium using a transport roller, the transport roller being for transporting the medium by rotating, an actual movement amount of the medium, when the transport roller transports the medium by a predetermined transport amount, changing in accordance with a rotational position of the rotating transport roller; specifying the rotational position of the transport roller based on the detected movement amount, and transporting property information of the transport roller, which indicates a change in the actual movement amount according to the rotational position; and correcting the transport amount when the transport roller transports the medium after the rotational position has been specified, based on rotational position information, which indicates the specified rotational position.

6 Claims, 9 Drawing Sheets

CORRECTION METHOD OF TRANSPORT AMOUNT AND MEDIUM TRANSPORT APPARATUS

CROSS-REFERENCE TO RELATED APPLICATIONS

The present application claims priority upon Japanese Patent Application No. 2006-247892 filed on Sep. 13, 2006, which is herein Incorporated by reference.

BACKGROUND

1. Technical Field

The present invention relates to correction methods of a transport amount, and medium transport apparatuses.

2. Related Art

Medium transport apparatuses for transporting a medium, such as inkjet printers, are already well known. Some of these medium transport apparatuses are provided with a transport roller for transporting a medium by rotating, and a movement amount detecting section for detecting a movement amount of the medium.

Even when the transport roller transports a medium by a target transport amount, the actual movement amount of the medium may not agree with the target transport amount, and a so-called transport error may occur. It is known that the actual movement amount of a medium when the transport roller transports the medium by a predetermined transport amount (target transport amount) changes in accordance with a rotational position of the rotating transport roller. Thus, the transport error also changes in accordance with the rotational position.

In the cases where such a transport error occurs, the transport amount when the transport roller transports the medium needs to be corrected. More specifically, the transport amount needs to be increased or decreased from the target transport amount such that the actual movement amount of the medium agrees with the target transport amount.

A conventional medium transport apparatus is provided with a rotational position detection sensor for detecting the rotational position of the transport roller, and a storing section that stores transporting property information of the transport roller, which indicates a change in the actual movement amount according to the rotational position. The transport error is obtained using the transporting property information, based on the rotational position that has been detected by the rotational position detection sensor, and the transport amount is corrected based on the obtained transport error.

However, providing the rotational position detection sensor is too costly, and thus there has been a demand for a medium transport apparatus that can correct the transport amount as appropriate without providing the rotational position detection sensor.

It should be noted that JP-A-05-96796 is an example of related techniques.

SUMMARY

The invention was achieved in view of the above-described problems, and it is an advantage thereof to realize a correction method of the transport amount and a medium transport apparatus that can correct as appropriate the transport amount when a transport roller transports a medium, without a rotational position detection sensor.

A primary aspect of the invention is a correction method of a transport amount as below.

A correction method of a transport amount, includes:

detecting a movement amount of a medium while transporting the medium using a transport roller, the transport roller being for transporting the medium by rotating, an actual movement amount of the medium, when the transport roller transports the medium by a predetermined transport amount, changing in accordance with a rotational position of the rotating transport roller;

specifying the rotational position of the transport roller based on the detected movement amount, and transporting property information of the transport roller, which indicates a change in the actual movement amount according to the rotational position; and correcting the transport amount when the transport roller transports the medium after the rotational position has been specified, based on rotational position information, which indicates the specified rotational position.

Other features of the invention will become clear through the accompanying drawings and the following description.

BRIEF DESCRIPTION OF THE DRAWINGS

For a more complete understanding of the invention and the advantages thereof, reference is now made to the following description taken in conjunction with the accompanying drawings.

DESCRIPTION OF EXEMPLARY EMBODIMENTS

Figure 1:
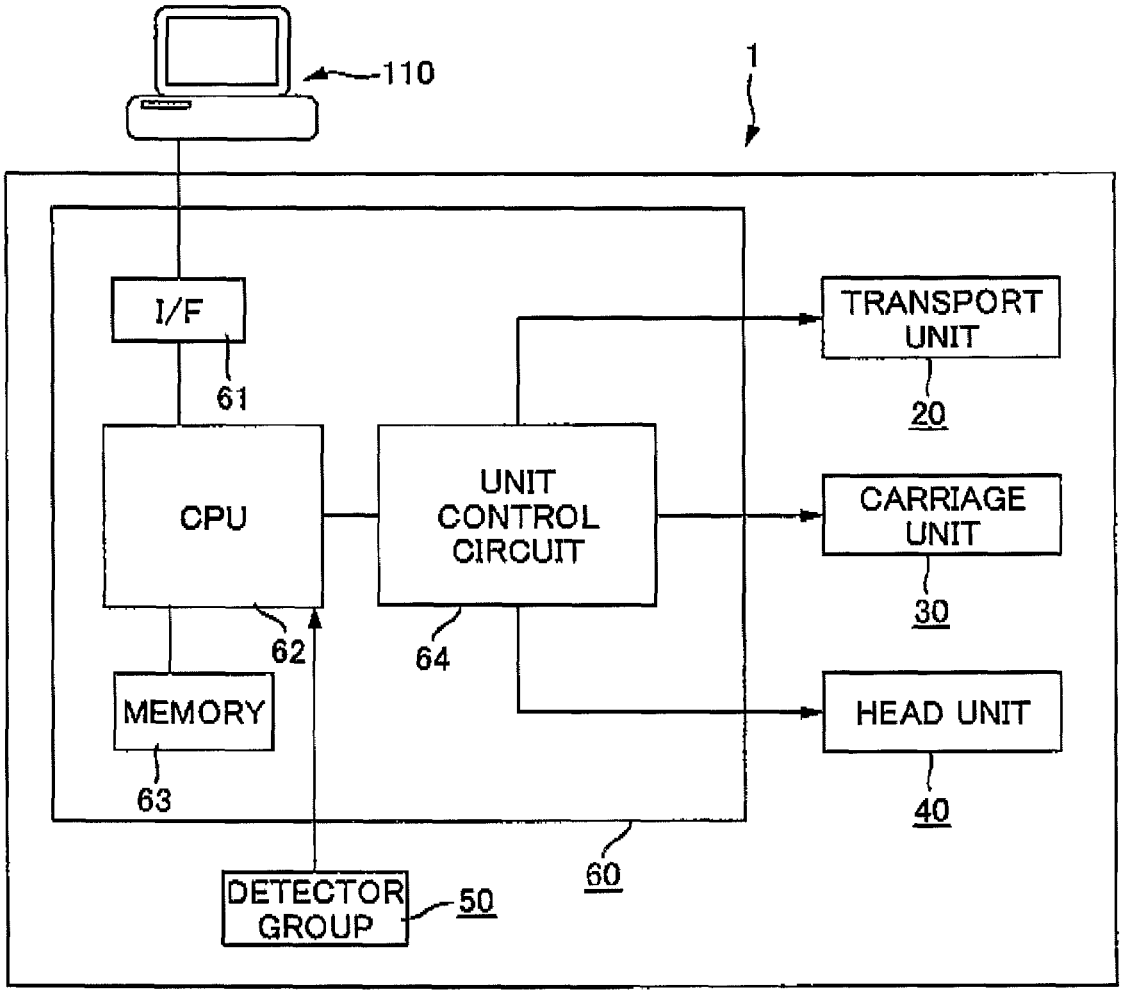
FIG. 1 is a block diagram of the overall configuration of a printer 1.

At least the following matters will be made clear by the explanation in the present specification and the description of the accompanying drawings.

A correction method of a transport amount, includes:

detecting a movement amount of a medium while transporting the medium using a transport roller, the transport roller being for transporting the medium by rotating, an actual movement amount of the medium, when the transport roller transports the medium by a predetermined transport, amount changing in accordance with a rotational position of the rotating transport roller;

specifying the rotational position of the transport roller based on the detected movement amount, and transporting property information of the transport roller, which indicates a change in the actual movement amount according to the rotational position; and correcting the transport amount when the transport roller transports the medium after the rotational position has been specified, based on rotational position information, which indicates the specified rotational position.

With this correction method of the transport amount, the transport amount when the transport roller transports a medium can be corrected as appropriate without a rotational position detection sensor.

Furthermore, the transport amount when the transport roller transports the medium after the rotational position has been specified may be corrected based on the rotational position information and the transporting property information.

In this case, exact correction can be performed.

Furthermore, a rotational position of the transport roller immediately before transporting the medium may be specified based on the detected movement amount and the transporting property information.

Furthermore, the rotational position of the transport roller may be specified based on the detected movement amount and the transporting property information, and after the rotational position has been specified, ejection of ink for performing printing may be started.

In this case, ink is always precisely ejected onto a desired position.

Furthermore, the transport roller may transport the medium in a predetermined transport direction by rotating, and a movement amount detecting section for detecting the movement amount of the medium may be positioned on an upstream side, in the transport direction, of a print head for ejecting the ink for performing printing.

In this case, ink is ejected as appropriate onto the upper end or its vicinity of the medium.

A medium transport apparatus, includes:

a transport roller that transports a medium by rotating, an actual movement amount of the medium when the transport roller transports the medium by a predetermined transport amount changing in accordance with a rotational position of the rotating transport roller;

a storing section that stores transporting property information of the transport roller, which indicates a change in the actual movement amount according to the rotational position;

a movement amount detecting section for detecting a movement amount of a medium; and a controller that causes to specify the rotational position of the transport roller based on the detected movement amount and the transporting property information, by causing the movement amount detecting section to detect the movement amount while causing the transport roller to transport the medium, and that corrects the transport amount when the transport roller transports the medium after the rotational position has been specified, based on rotational position information, which indicates the specified rotational position.

With this medium transport apparatus, the transport amount when the transport roller transports a medium can be corrected as appropriate without a rotational position detection sensor.

Configuration of the Printer

Regarding the Configuration of the Inkjet Printer

Figure 2A:
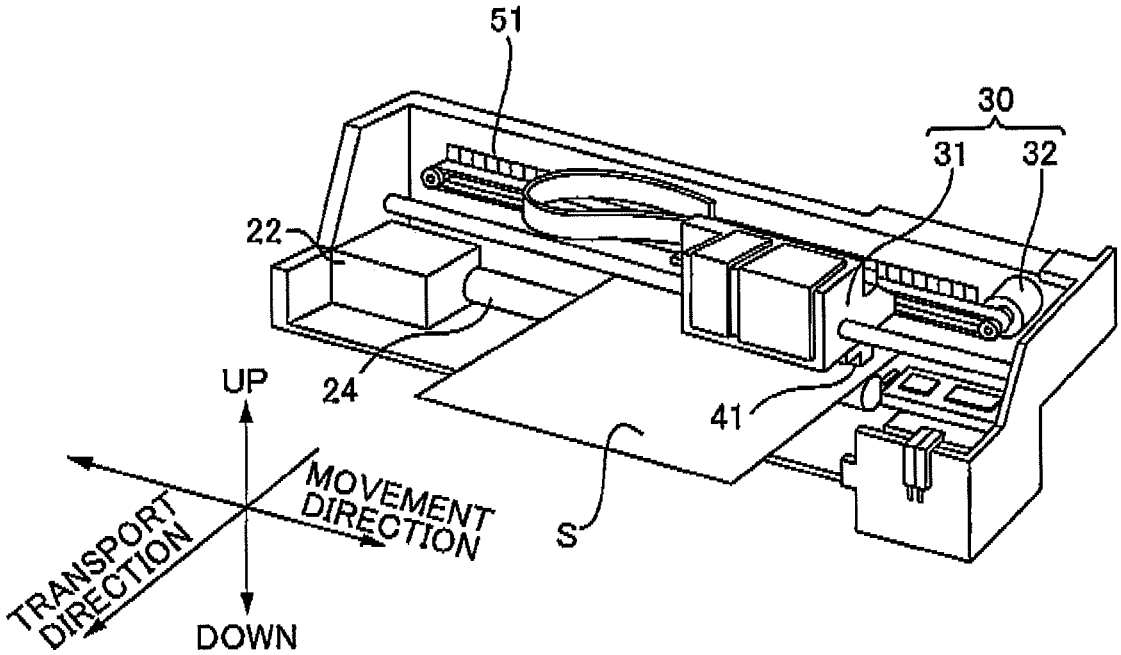
FIG. 2A is a schematic view of the overall configuration of the printer 1.
Figure 2B:
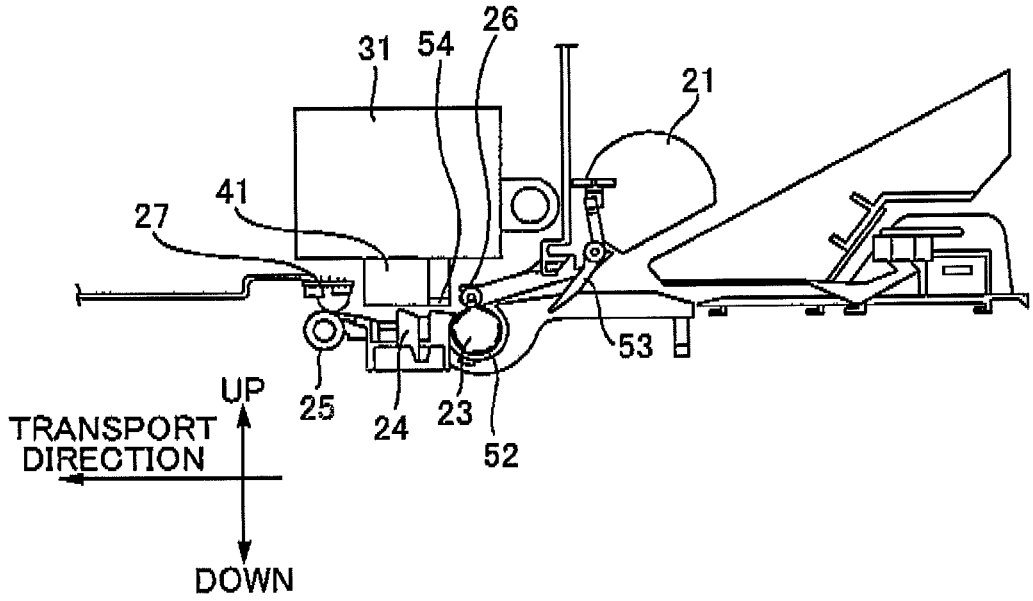
FIG. 2B is a cross-sectional view of the overall configuration of the printer 1.

FIG. 1 is a block diagram of the overall configuration of an inkjet printer (hereinafter, also referred to as a printer 1) as an example of a medium transport apparatus. FIG. 2A is a schematic view of the overall configuration of the printer 1. FIG. 2B is a cross-sectional view of the overall configuration of the printer 1. Hereinafter, the basic configuration of the printer shall be described.

The printer 1 includes a transport unit 20, a carriage unit 30, a head unit 40, a detector group 50, and a controller 60. Having received print data from a computer 110, which is an external device, the printer 1 controls the units (the transport unit 20, the carriage unit 30, and the head unit 40) with the controller 60, The controller 60 controls the units based on the print data that has been received from the computer 110 to print an image on a paper. The detector group 50 monitors the conditions inside the printer 1, and outputs detection results to the controller 60. The controller 60 controls the units based on the detection results that have been output from the detector group 50.

The transport unit 20 is for transporting a medium (such as paper S, for example) in a predetermined transport direction. The transport unit 20 includes a paper feed roller 21, a transport motor 22 (also referred to as a PF motor), a transport roller 23, a platen 24, and a paper discharge roller 25. The paper feed roller 21 is a roller for feeding paper that has been inserted into a paper insert opening into the printer. The transport roller 23 is a roller that rotates to transport the paper S that has been fed by the paper feed roller 21 up to a printable region, and is driven by the transport motor 22. The platen 24 supports the paper S on which printing is being performed. The paper discharge roller 25 is a roller for discharging the paper S to the outside of the printer, and is provided on the downstream side of the printable region in the transport direction. The paper discharge roller 25 is rotated in synchronization with the transport roller 23. It should be noted that when the transport roller 23 transports the paper S, the paper S is held between the transport roller 23 and a driven roller 26. Accordingly, the posture of the paper S is kept stable. On the other hand, when the paper discharge roller 25 transports the paper S, the paper S is held between the paper discharge roller 25 and a driven roller 27.

The carriage unit 30 is for moving (also referred to as scanning) the head in a predetermined direction (hereinafter referred to as a movement direction), the head being an example of a print head for ejecting ink. The carriage unit 30 includes a carriage 31 and a carriage motor 32 (also referred to as a CR motor). The carriage 31 can move back and forth in the movement direction, and is driven by the carriage motor 32. Furthermore, the carriage 31 detachably holds an ink cartridge that contains ink.

The head unit 40 is for ejecting ink onto paper. The head unit 40 is provided with a head 41 having a plurality of nozzles. The head 41 is provided on the carriage 31, and thus when the carriage 31 moves in the movement direction, the head 41 also moves in the movement direction. When the head 41 intermittently ejects ink while moving in the movement direction, dot lines (raster lines) are formed on the paper in the movement direction.

The detector group 50 includes a carriage position detector 51, a transport roller rotation amount detector 52 (see FIG. 4), a paper movement amount detector 55 (see FIG. 8, not shown in FIG. 2B) as an example of a movement amount detecting section, a paper front end position detection sensor 53, and an optical sensor 54, for example. The carriage position detector 51 detects the position of the carriage 31 in the movement direction. The transport roller rotation amount detector 52 detects the rotation amount of the transport roller 23 (described later in detail). The paper movement amount detector 55 detects the movement amount of the paper when the paper is transported by the transport roller 23 (described later in detail). The paper front end position detection sensor 53 detects the position of the front end of the paper that is being fed. The optical sensor 54 detects whether or not a paper is present, using a light-emitting section and a light-receiving section attached to the carriage 31. The optical sensor 54 can detect the width of paper by detecting the position of end portions of the paper while being moved by the carriage 31. Depending on the circumstances, the optical sensor 54 can also detect the front end (an end-portion on the downstream side in the transport direction, also referred to as an upper end) and the rear end (an end portion on the upstream side in the transport direction, also referred to as a lower end) of the paper. It should be noted that the printer 1 according to this embodiment is not provided with a rotational position detection sensor for detecting the rotational position of the transport roller 23.

The controller 60 is a control unit (controller) for controlling the printer. The controller 60 includes an interface section 61, a CPU 62, a memory 63 as an example of a storing section for storing information, and a unit control circuit 64. The interface section 61 exchanges data between the computer 110, which is an external device, and the printer 1. The CPU 62 is a processing unit for controlling the entire printer. The memory 63 is for securing an area for storing programs for the CPU 62, a working area, and the like, and includes a storage element such as a RAM, which is a volatile memory, or an EEPROM, which is a non-volatile memory. The CPU 62 controls the units via the unit control circuit 64 according to the programs stored in the memory 63.

Regarding the Nozzles

Figure 3:
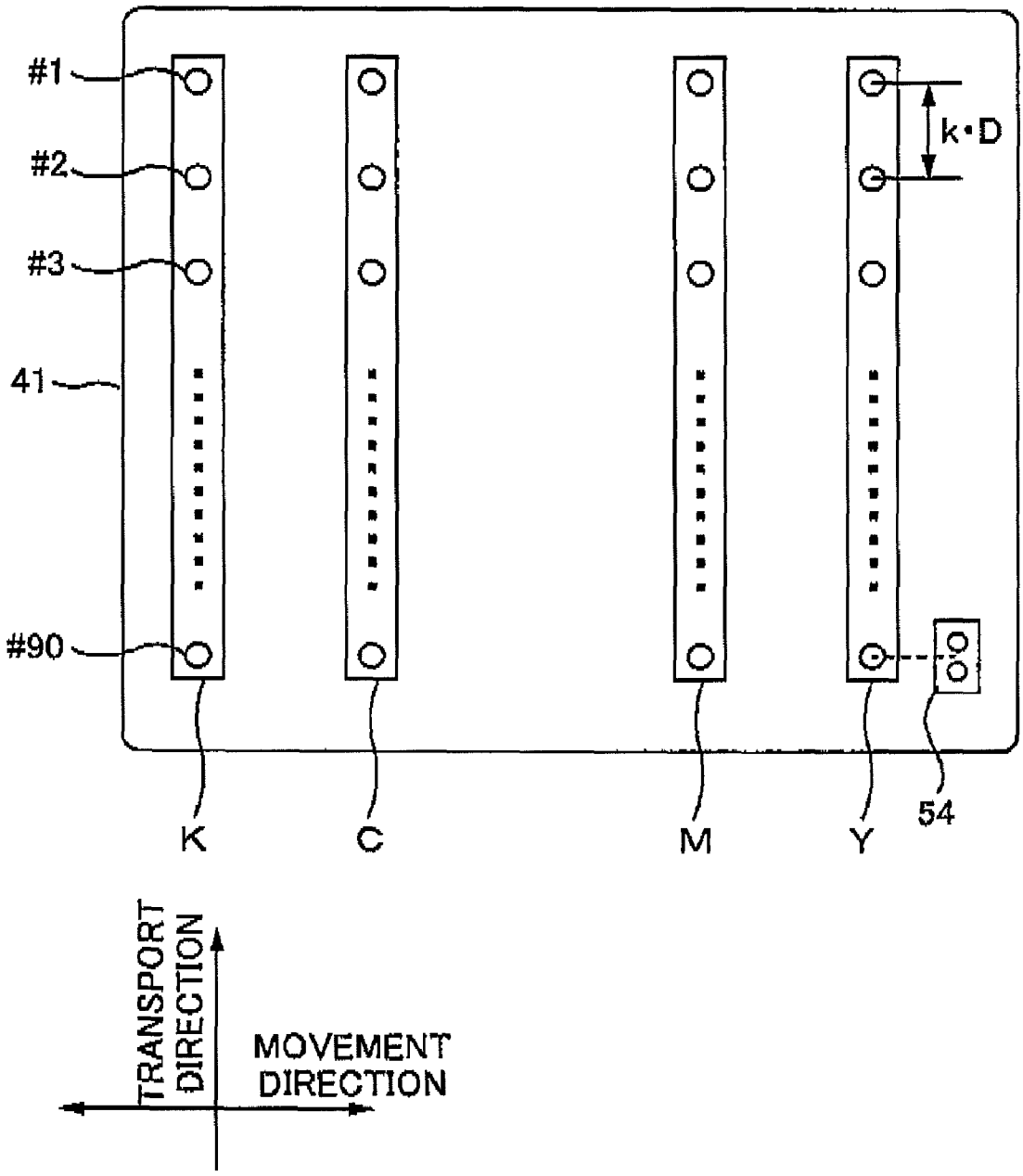
FIG. 3 is an explanatory diagram showing the arrangement of nozzles.

FIG. 3 is an explanatory diagram showing the arrangement of nozzles on a lower face of the head 41. A black ink nozzle group K, a cyan ink nozzle group C, a magenta ink nozzle group M, and a yellow ink nozzle group Y are formed on the lower face of the head 41. Each nozzle group is provided with 90 nozzles that are ejection openings for ejecting ink of each color.

The plurality of nozzles of each nozzle group are arranged in a row at constant intervals (nozzle pitch: k·D) in the transport direction. Herein, D is the minimum dot pitch (that is, an interval at the maximum resolution of dots formed on the paper S) in the transport direction, and k is an integer of 1 or more. For example, if the nozzle pitch is 90 dpi (1/90 inches) and the dot pitch in the transport direction is 720 dpi (1/720 inches), then k=8.

The nozzles of each nozzle group are assigned numbers (#1 to #90) that become smaller toward the downstream side. That is to say, the nozzle #1 is positioned on the downstream side of the nozzle #90 in the transport direction. It should be noted that the optical sensor 54 described above is at substantially the same position as the nozzle #90, which is on the furthest upstream side with respect to its position in the paper transport direction.

Each nozzle is provided with an ink chamber (not shown) and a piezo element. The ink chamber is constricted or expanded due to the driving of the piezo element, and ink droplets are ejected from the nozzle.

Transport Error

Regarding Paper Transport

Figure 4:
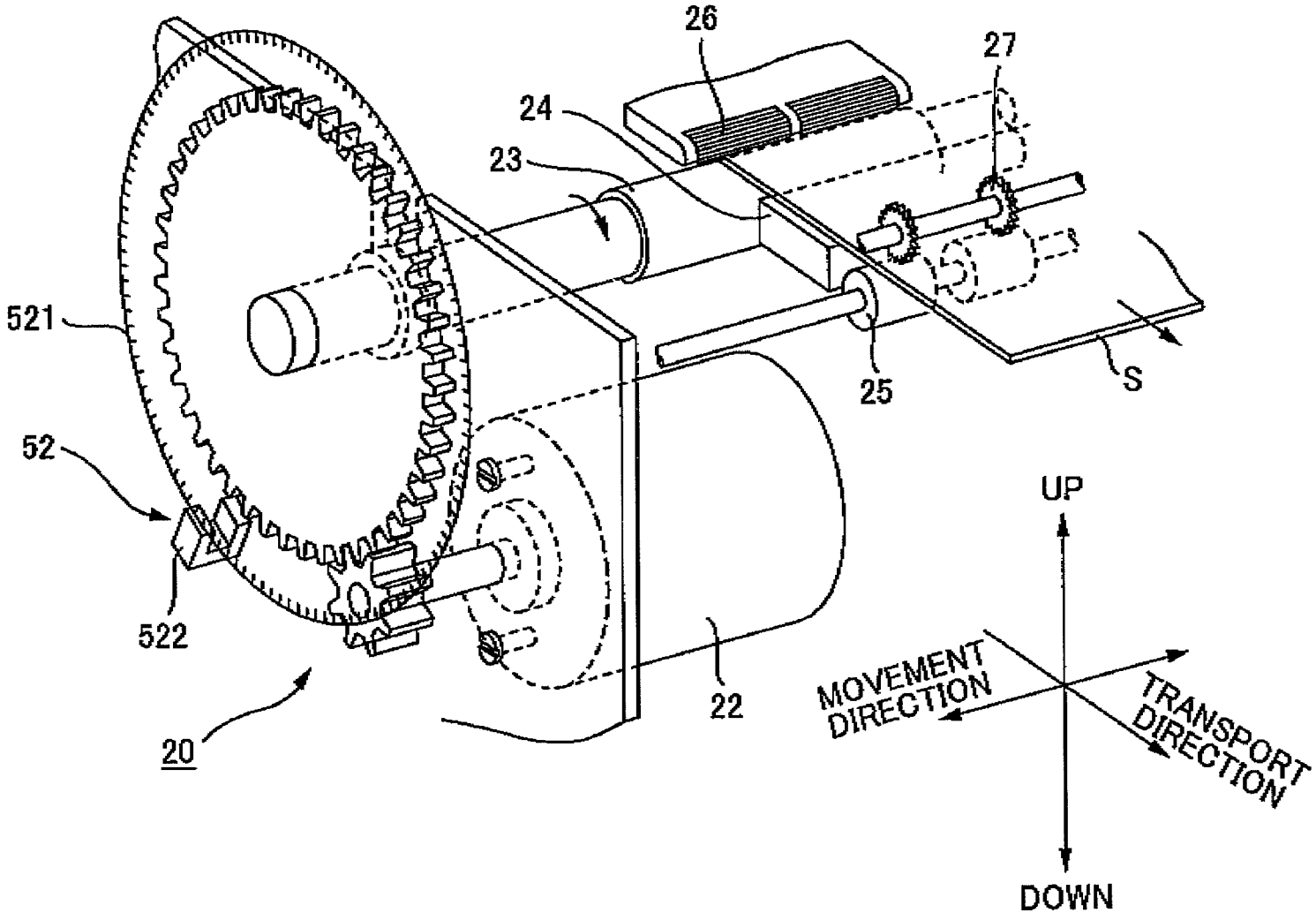
FIG. 4 is an explanatory diagram of the configuration of a transport unit 20.

FIG. 4 is an explanatory diagram of the configuration of the transport unit 20.

The transport unit 20 drives the transport motor 22 by a predetermined driving amount based on a transport command from the controller 60. The transport motor 22 generates a driving force in the rotational direction according to the driving amount given in the command. The transport motor 22 rotates the transport roller 23 with this driving force. More specifically, when the transport motor 22 generates a predetermined driving amount, the transport roller 23 rotates by a predetermined rotation amount. The transport roller 23 rotates by the predetermined rotation amount, thereby transporting paper by a predetermined transport amount. In this embodiment, the circumferential length of the transport roller 23 is 1 inch. Thus, for example, the transport roller 23 needs to rotate one quarter (rotate 90 degrees) in order to transport paper by ¼ inches.

Furthermore, the transport roller rotation amount detector 52 is provided in order to detect the rotation amount of the transport roller 23. The transport roller rotation amount detector 52 includes a scale 521 and a slit detecting section 522. The scale 521 has a large number of slits provided at predetermined intervals. The scale 521 is provided on the transport roller 23. That is to say, when the transport roller 23 rotates, the scale 521 rotates together therewith. When the transport roller 23 rotates, the slits of the scale 521 sequentially pass through the slit detecting section 522. The slit detecting section 522 is provided in opposition to the scale 521, and fixed to the printer main unit. The transport roller rotation amount detector 52 outputs a pulse signal each time a slit provided on the scale 521 passes through the slit detecting section 522. The slits provided on the scale 521 sequentially pass through the slit detecting section 522 in accordance with the rotation amount of the transport roller 23, and thus the rotation amount of the transport roller 23 is detected based on the output from the transport roller rotation amount detector 52.

For example, if the paper is to be transported by one inch, the controller 60 drives the transport motor 22 until the transport roller rotation amount detector 52 detects that the transport roller 23 has rotated once. In this manner, the controller 60 drives the transport motor 22 until the transport roller rotation amount detector 52 detects that the rotation amount corresponds to an amount by which transport is to be performed (target transport amount).

Regarding the Transport Error

As described above, the controller 60 drives the transport motor 22 until the transport roller rotation amount detector 52 detects that the rotation amount corresponds to an amount by which transport is to be performed (target transport amount). However, at that time, the actual movement amount of the paper may not agree with the target transport amount in the strict sense, and a so-called transport error may occur. It is known that the actual movement amount of the paper when the transport roller 23 transports the paper by a predetermined transport amount (target transport amount) changes in accordance with the rotational position of the rotating transport roller 23. Thus, the transport error also changes in accordance with the rotational position.

Figure 5:
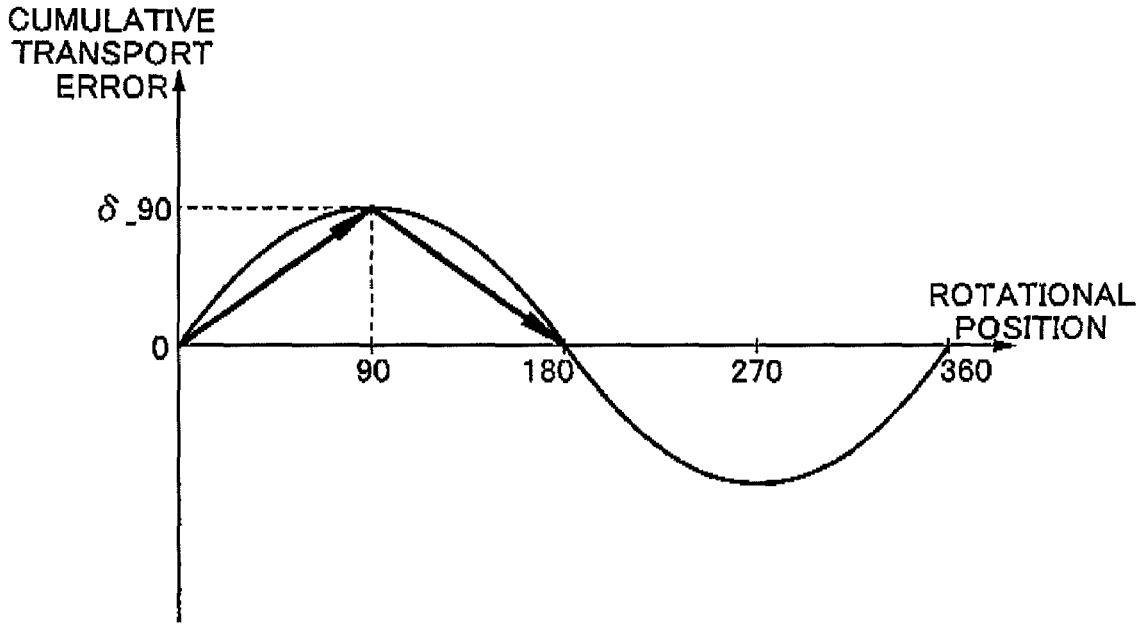
FIG. 5 is a graph illustrating a change in the actual movement amount (and a transport error) of paper according to the rotational position of a transport roller 23.

FIG. 5 is a graph illustrating a change in the actual movement amount (and a transport error) of the paper according to the rotational position of the transport roller 23. The horizontal axis indicates a rotational position of the transport roller 23, in one rotation that is given as 360 degrees, using a certain rotational position (hereinafter, referred to as a reference rotational position) of the transport roller 23 as a reference. Furthermore, the vertical axis indicates a cumulative transport error from the reference rotational position. For example, if the transport roller 23 transports paper by ¼ inches by rotating one quarter (90 degrees) from the reference rotational position, then a transport error of δ_90 inches occurs, and the actual movement amount of the paper becomes ¼+δ_90 inches. Furthermore, if the transport roller 23 transports the paper by ¼ inches by rotating another one quarter (90 degrees) from the position that has been reached by the rotation of one quarter (90 degrees), then a transport error of −δ_90 (=0−δ_90) inches occurs, and the actual movement amount of the paper becomes ¼−δ_90 inches. In this manner, the transport error and the actual movement amount of paper when the transport roller 23 transports the paper by a predetermined transport amount (target transport amount) change in accordance with the rotational position of the rotating transport roller 23. It should be noted that the graph of the cumulative transport error shown in FIG. 5 is substantially a sine curve, although it slightly varies, depending on a value of the coefficient of friction when the transport roller 23 is in contact with the back face of paper, or the production precision of the transport roller 23.

Correction Method of the Transport Amount

General Outline

As described above, even when the transport roller transports paper by a target transport amount, the actual movement amount of the paper may not agree with the target transport amount, and a so-called transport error may occur. It is known that the actual movement amount of paper when the transport roller transports the paper by a predetermined transport amount (target transport amount) changes in accordance with a rotational position of the rotating transport roller, and thus the transport error also changes in accordance with the rotational position.

In the case where such a transport error occurs, the transport amount when the transport roller transports the paper needs to be corrected. More specifically, the transport amount needs to be increased or decreased from the target transport amount such that the actual movement amount of the paper agrees with the target transport amount.

A conventional printer is provided with a rotational position detection sensor for detecting the rotational position of the transport roller, and a memory that stores transporting property information of the transport roller (such as the graph shown in FIG. 5, for example), which indicates a change in the actual movement amount according the rotational position. The transport error is obtained using the transporting property information, based on the rotational position that has been detected by the rotational position detection sensor, and the transport amount is corrected based on the obtained transport error.

However, providing the rotational position detection sensor is too costly, and thus there has been a demand for a printer that can correct the transport amount as appropriate without providing a rotational position detection sensor.

The printer 1 according to this embodiment is not provided with a rotational position detection sensor. In the printer 1, a correction method of the transport amount is performed that can correct as appropriate the transport amount when the transport roller 23 transports paper, without the rotational position detection sensor.

Figure 6:
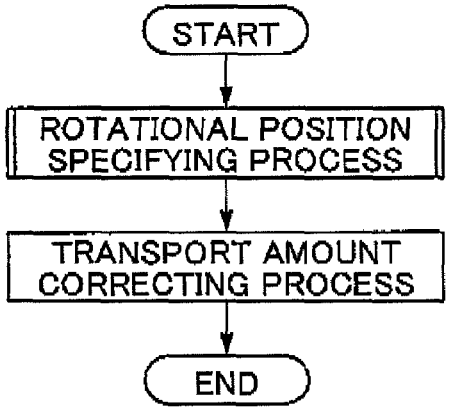
FIG. 6 is a flowchart illustrating a correction method of the transport amount according to this embodiment.

FIG. 6 is a flowchart illustrating the correction method of the transport amount according to this embodiment. As shown in this flowchart, the correcting method can be divided into: a rotational position specifying process of specifying the rotational position of the transport roller 23 (more specifically, the rotational position of the transport roller 23 immediately before transporting paper) based on a movement amount of the paper and the transporting property information, the movement amount being detected by the paper movement amount detector 55 in a state where the transport roller 23 transports the paper; and a transport amount correcting process of correcting the transport amount when the transport roller 23 transports the medium after the rotational position is specified, based on the rotational position information, which indicates the specified rotational position.

In the following sections, both processes shall be described in more detail. It should be noted that various operations of the printer 1 described below (in the following sections) are mainly realized by the controller 60 inside the printer 1. More specifically, in this embodiment, the operations are realized by the CPU 62 executing programs stored in the memory 63. These programs are constituted by codes for performing various operations described below.

Furthermore, in this embodiment, as the transporting property information, the graph shown in FIG. 5 is used that indicates the relationship between the rotational position of the transport roller 23 and the cumulative transport error. This graph is acquired in the production step or the like of the printer 1 before shipment of the printer 1, and is stored in the above-mentioned EEPROM (that is, the graph as the transporting property information is stored in advance in the EEPROM of the printer 1 after shipment).

Rotational Position Specifying Process

Figure 7:
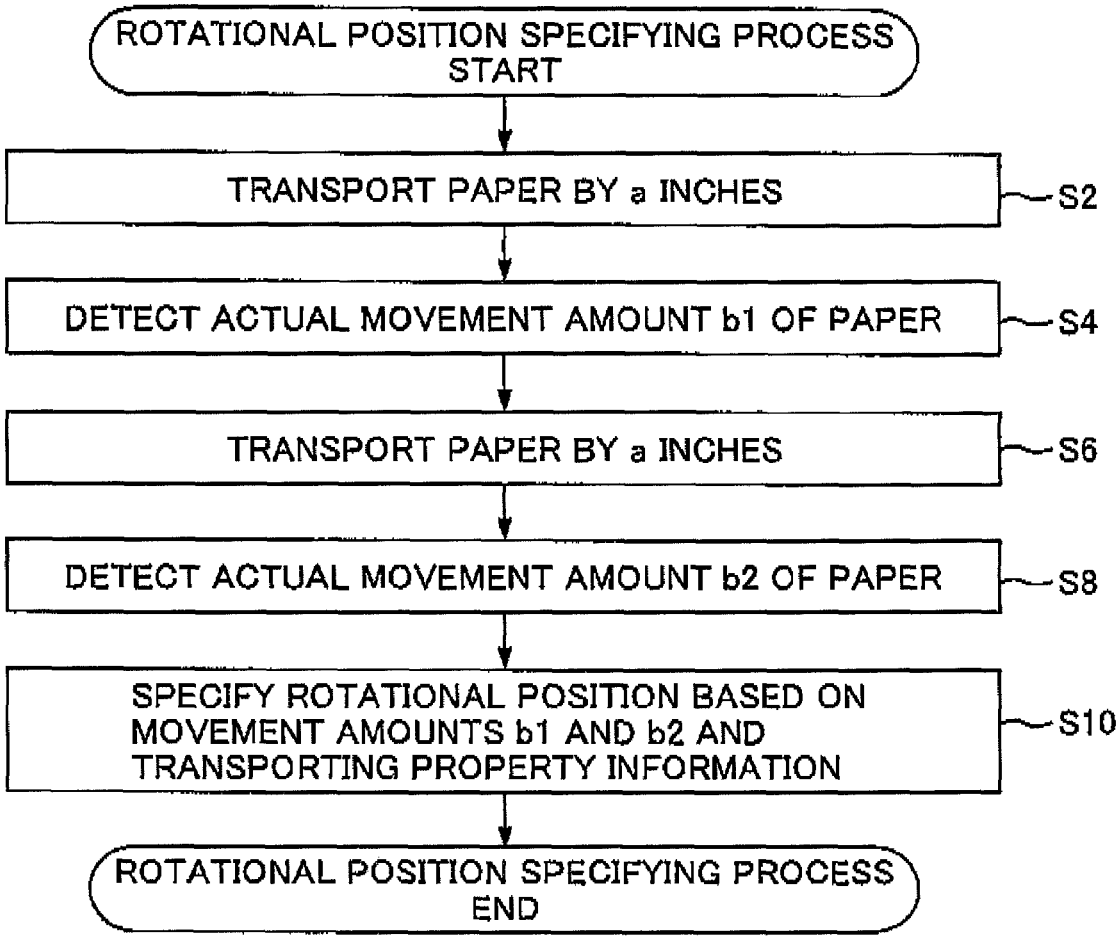
FIG. 7 is a flowchart illustrating a rotational position specifying process.

FIG. 7 is a flowchart illustrating the rotational position specifying process. The rotational position specifying process is started taking, as a trigger, the event that the printer 1 receives a print command (print data) from the computer 110, for example.

First, in order to transport paper by a predetermined transport amount (herein, it is assumed that the predetermined transport amount is determined in advance and its value is stored in the memory 63: this value is given as a inches), the controller 60 rotates the transport roller 23 by a predetermined angle (the predetermined angle is 360×a degrees) (step S2). The paper movement amount detector 55 detects the actual movement amount of the paper in this transport (it is assumed that the detected movement amount is b1 inches: step S4).

Figure 8:
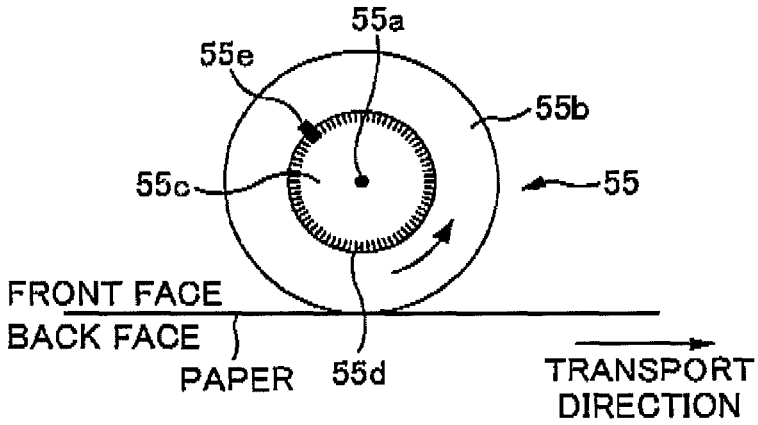
FIG. 8 is an explanatory diagram for illustrating the detecting principle of a paper movement amount detector 55.

FIG. 8 is an explanatory diagram for illustrating the detecting principle of the paper movement amount detector 55. The paper movement amount detector 55 is provided with a roller section 55*b* that rotates about a rotational shaft 55*a* while being in contact with the front face of paper, in accordance with movement of the paper along the transport direction, a scale 55*c* that rotates together with the roller section 55*b* and that has a large number of slits 55*d* provided at predetermined intervals, and a slit detecting section 55*e* for detecting the slits 55*d*. When the paper moves along the transport direction, the scale 55*c* rotates together with the roller section 55*b*. The paper movement amount detector 55 outputs a pulse signal each time the slit 55*d* provided on the scale 55*c* passes through the slit detecting section 55*e*. The movement amount of the paper is detected based on (the number of) the pulse signals.

The paper movement amount detector 55 is provided so as to be in contact with an end portion in the width direction of the paper, and is biased by a biasing member (not shown) toward the paper such that the paper movement amount detector 55 is in contact with the paper as appropriate. Furthermore, since the paper movement amount detector 55 is provided so as to be in contact (not with the back face, but) with the front face of the paper, the detection precision is very high.

After the paper movement amount detector 55 detects the actual movement amount of the paper in step S4, the controller 60 rotates the transport roller 23 by 360×a degrees in order to transport the paper by another a inches (step S6). Also at that time, the paper movement amount detector 55 detects the actual movement amount of the paper (it is assumed that the movement amount detected at that time is b2 inches: step S8).

Next, the rotational position of the transport roller 23 (more specifically, the rotational position of the transport roller 23 immediately before transporting the paper) is specified based on the detected movement amounts b1 and b2, and the transporting property information (the graph in FIG. 5) (step S10).

Figure 9:
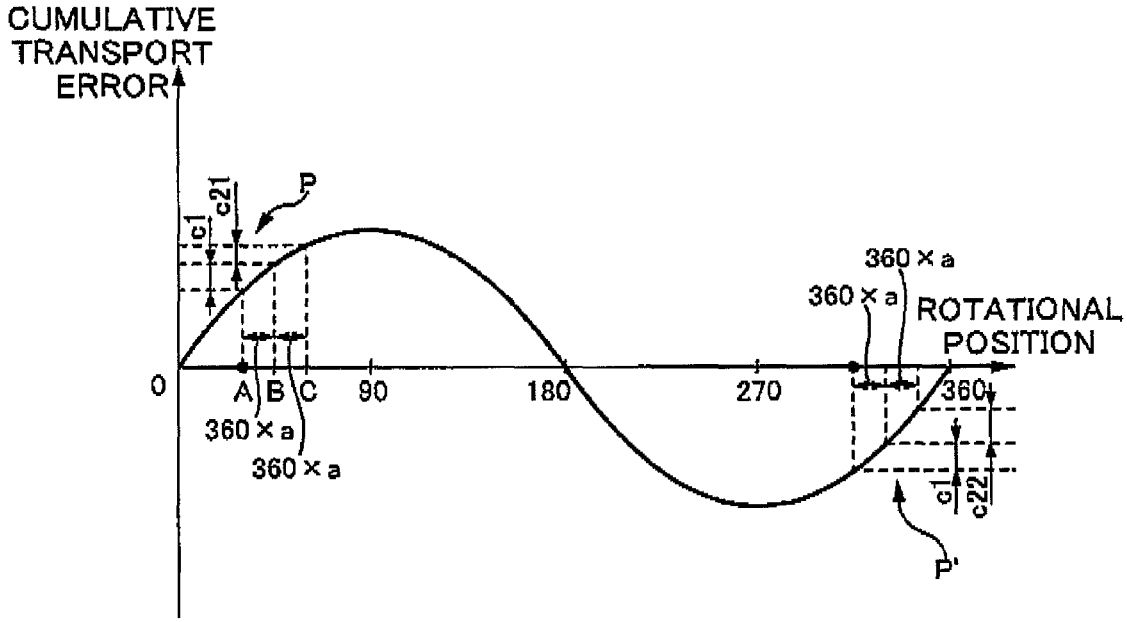
FIG. 9 is an explanatory graph for illustrating a method for specifying the rotational position using the transporting property information.

FIG. 9 is an explanatory graph for illustrating a method for specifying the rotational position using the transporting property information. The controller 60 obtains a transport error c1 (=movement amount b1−transport amount a) that has occurred in the transport in step S2, and a transport error c2 (=movement amount c2−transport amount a) that has occurred in the transport in step S6, based on the detected movement amounts b1 and b2. Then, a point on the graph at which a transport error of c1 inches occurs due to a transport by a inches (rotation by 360×a degrees) is searched for using numerical analysis or the like.

As described above, the graph regarding the transporting property information is substantially a sine curve, and thus there are two points at which a transport error of c1 inches occurs due to a transport by a inches (rotation by 360×a degrees)(the points are indicated by the symbols P and P' in FIG. 9), and these points P and P' are searched for.

Next, it is judged which one of the two points P and P' is a point at which a transport error of c2 inches occurs due to a transport by another a inches (rotation by 360×a degrees) (the two points are narrowed down to one point). For example, the graph indicates that a transport error of c21 inches occurs due to the transport by another a inches (rotation by 360×a degrees) at the point P, and that a transport error of c22 inches occurs due to the transport by another a inches (rotation by 360×a degrees) at the point P', and c21 is closer to c2 than c22, In this case, it is judged that the correct point is P.

When the point P on the graph is found as described above, the rotational position of the transport roller 23 immediately before transporting the paper is specified (this rotational position is indicated by the symbol A in FIG. 9).

Transport Amount Correcting Process

Once the rotational position A of the transport roller 23 immediately before transporting the paper is specified in the rotational position specifying process, the subsequent rotational positions are always known (in other words, it is always possible to know a point on the X-axis in FIG. 9 at which a current rotational position is present), because all of the transport amounts (including the transport amount a and the like) when the transport roller 23 subsequently transports the paper are known. Then, after the rotational position is specified, the transport amount when the transport roller 23 transports the paper can be corrected as appropriate (described later in detail).

If the controller 60 is to transport the paper by ax inches, first, a correction value $\alpha$ is obtained. Then, the transport roller 23 is rotated by 360×(ax+$\alpha$) degrees in order to transport the paper by ax+$\alpha$ inches.

Figure 10:
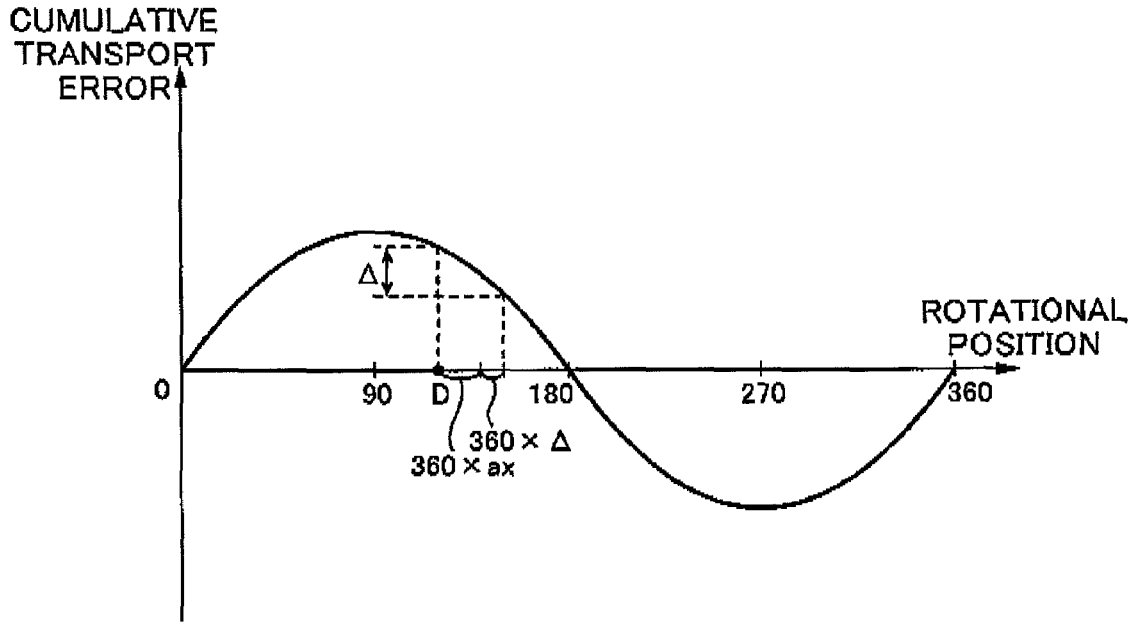
FIG. 10 is an explanatory graph for illustrating a correction method of the transport amount using the transporting property information.

Next, the manner in which the correction value $\alpha$ is obtained shall be described with reference to FIG. 10. FIG. 10 is an explanatory graph for illustrating a correction method of the transport amount using the transporting property information. Referring to the graph in FIG. 10, the controller 60 obtains a value $\Delta$ at which the actual movement amount of paper is ax inches when the paper is transported by ax+$\Delta$ inches. More specifically, a value $\Delta$ is obtained via numerical analysis and the like (using the value $\Delta$) with reference to the graph in FIG. 10, the value $\Delta$ satisfying the condition that a transport error of −$\Delta$ inches occurs due to a transport by ax+$\Delta$ inches (rotation by 360×(ax+$\Delta$) degrees) from a known current rotational position (this rotational position is obtained based on the rotational position A that has been specified in the rotational position specifying process, and is indicated by the symbol D in FIG. 10). This value $\Delta$ serves as the above-mentioned correction value $\alpha$.

It should be noted that in this embodiment, also when the paper is transported by the corrected transport amount, the paper movement amount detector 55 detects the actual movement amount of the paper.

Considering that the transport amount is corrected as described above such that the actual movement amount of the paper agrees with the target transport amount, the actual movement amount of the paper detected by the paper movement amount detector 55 is to agree with the target transport amount. However, actually, the transporting properties of the transport roller 23 come to differ from the properties indicated in the transporting property information stored in the EEPROM due to abrasion and the like of the transport roller 23, and a slight difference appears therebetween.

Considering this point, in this embodiment, the difference dif (when the transport amount is given as ax, and the actual movement amount of the paper detected by the paper movement amount detector 55 is given as bx, then the difference dif=bx−ax) is calculated. The calculation results are taken into account when the transport amount is corrected next time. For example, if a value of the difference dif is dif1 in the $n^{th}$ transport, then paper is transported in the $n+1^{th}$ transport by a transport amount that is smaller by dif1 than a corrected transport amount (such as ax+$\alpha$ inches, as described above). Also at that time, after the actual movement amount of the paper is detected, the difference dif is calculated (the calculated value is given as dif2), and paper is transported in the $n+2^{th}$ transport by a transport amount that is smaller by dif2 than a corrected transport amount.

Regarding the Time to Start Ejection of Ink

Figure 11A:
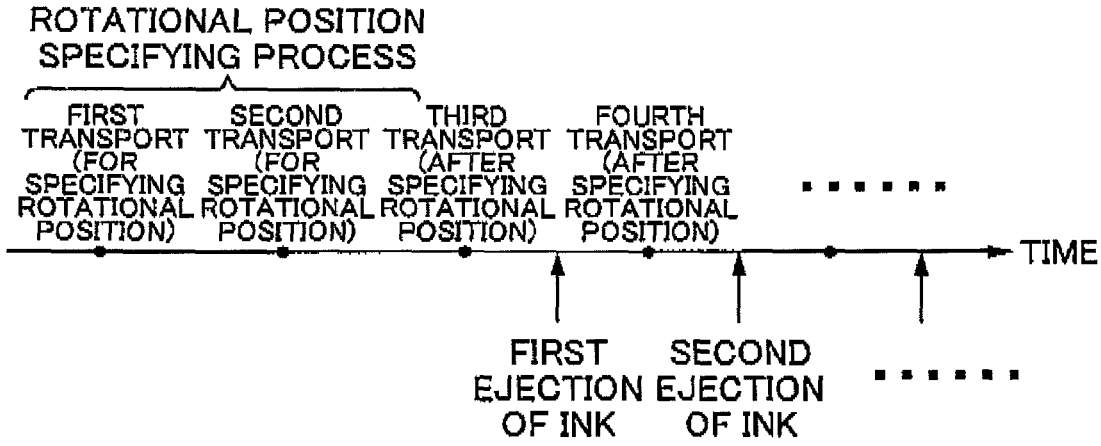
FIG. 11A is a diagram illustrating (a first example of) two examples regarding the time to start ejection of ink.
Figure 11B:
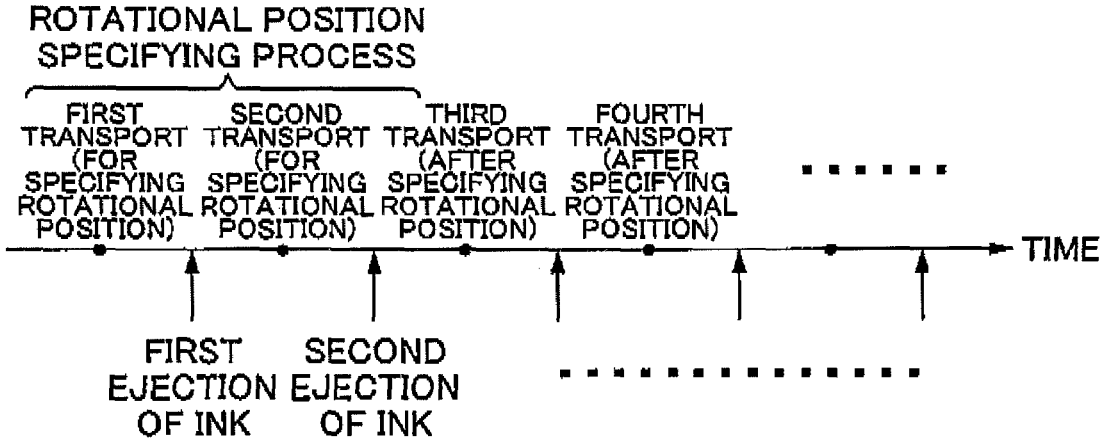
FIG. 11B is a diagram illustrating (a second example of) two examples regarding the time to start ejection of ink.

FIGS. 11A and 11B are diagrams illustrating two examples regarding the time to start ejection of ink. As described above, and as shown in FIGS. 11A and 11B, the rotational position specifying process is started taking, as a trigger, the event that the printer 1 receives a print command (print data) from the computer 110, for example, and two (the first and the second) paper transports (step S2 and step S6 in the flowchart in FIG. 7) are performed in this process. Then, in paper transports (the third and the subsequent paper transports) after the rotational position is specified in the rotational position specifying process, the transport amount can be corrected.

FIG. 11A illustrates an example according to this embodiment, in which the head 41 starts ejection of ink for performing printing after the rotational position is specified. After the rotational position is specified, the transport amount can be corrected, and thus transport precision in paper transports (the third and the subsequent paper transports) becomes high. On the other hand, before the rotational position is specified, the transport amount is not corrected, and thus transport precision in paper transports (the first and the second paper transports) is low. Accordingly, the example in FIG. 11A in which the head 41 starts ejection of ink for performing printing after the rotational position is specified is preferable in that ink is always precisely ejected onto a desired position.

However, there is no limitation to this, and an example as shown in FIG. 11B is also conceivable. FIG. 11B illustrates an example that is different from this embodiment, in which the head 41 starts ejection of ink for performing printing before the rotational position is specified. In this example, ejection of ink is started between the first paper transport and the second paper transport in the rotational position specifying process. Accordingly, the transport amount in the first and the second paper transports is a variable in this example, while it is a fixed value (a inches) in the example according to this embodiment.

In particular, in the case of an example as shown in FIG. 11A, the paper movement amount detector 55 is preferably positioned on the upstream side of the head 41 in the transport direction.

Figure 12A:
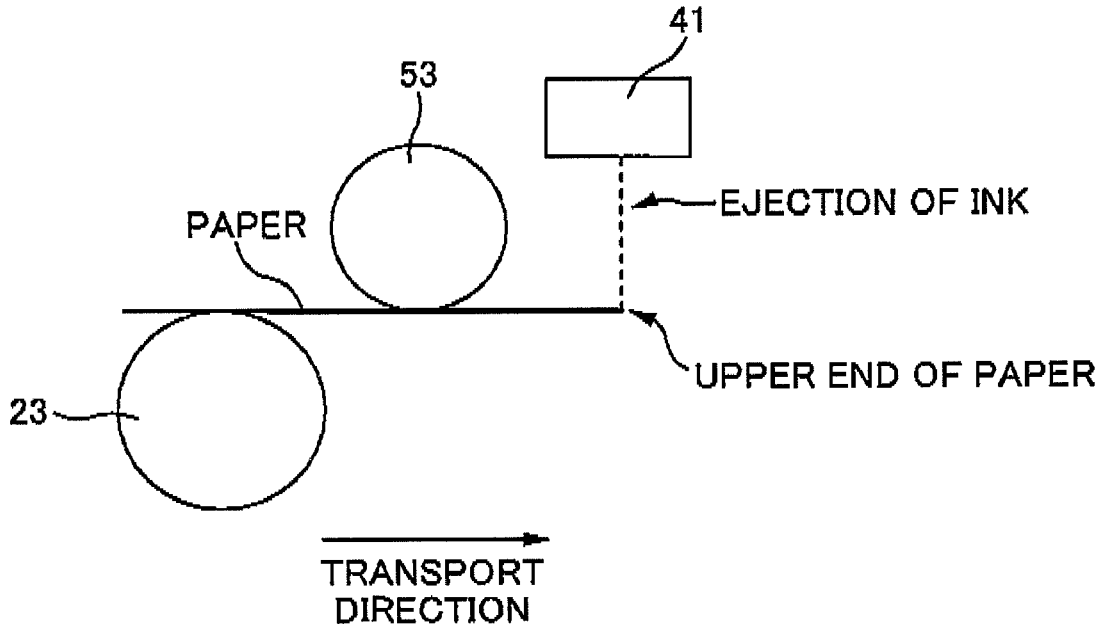
FIG. 12A is a (first) explanatory diagram for illustrating a superiority of a state in which the paper movement amount detector 55 is positioned on the upstream side of a head 41.
Figure 12B:
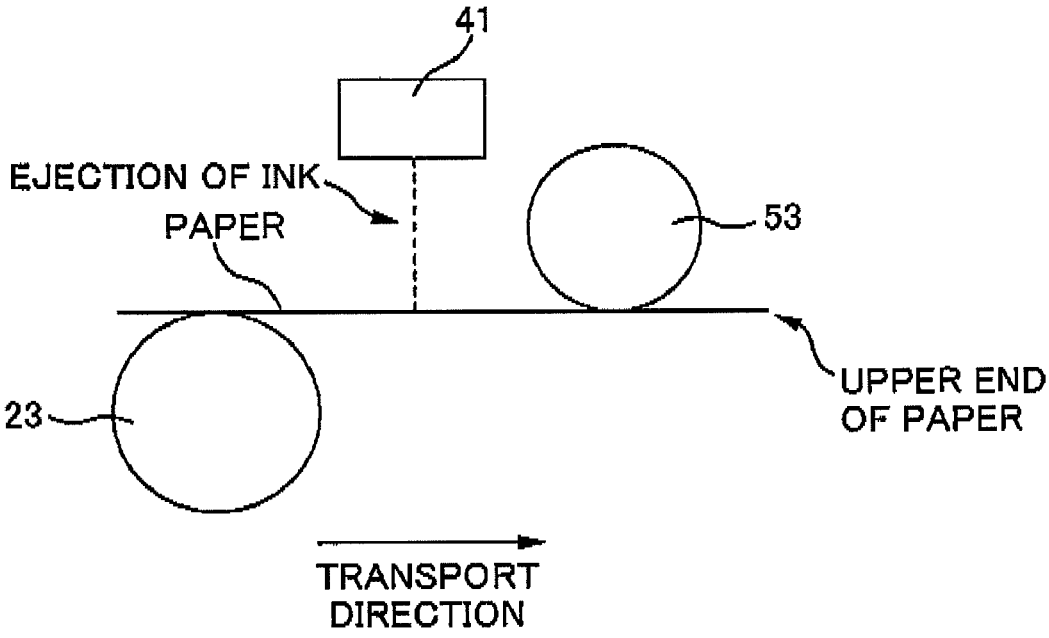
FIG. 12B is a (second) explanatory diagram for illustrating a superiority of a state in which the paper movement amount detector 55 is positioned on the upstream side of the head 41.

FIGS. 12A and 12B are explanatory diagrams for illustrating a superiority of a state in which the paper movement amount detector 55 is positioned on the upstream side of the head 41. FIG. 12 shows a state in which the paper movement amount detector 55 is positioned on the upstream side of the head 41 (superior example). FIG. 12B shows a state in which the paper movement amount detector 55 is positioned on the downstream side of the head 41 (non-superior example).

As described above, when paper is transported (when the first or the second paper transport is performed) in the rotational position specifying process, the paper movement amount detector 55 detects the actual movement amount of the paper, and thus the upper end of the paper needs to have reached the paper movement amount detector 55. Thus, when ejection of ink is started after the rotational position specifying process has finished, the upper end of the paper is positioned on the downstream side of the paper movement amount detector 55 in the transport direction as shown in FIGS. 12A and 12B.

Herein, if the paper movement amount detector 55 is positioned on the downstream side of the head 41 as shown in FIG. 12B, the upper end of the paper has passed by the head 41 and is significantly away therefrom in the transport direction when ejection of ink is started, and thus the ink cannot be ejected onto the upper end or its vicinity of the paper. On the other hand, if the paper movement amount detector 55 is positioned on the upstream side of the head 41 as shown in FIG. 11A, the upper end of the paper has not passed by the head 41 in the transport direction (or even if the upper end has passed by the head 41, the degree is slight) when ejection of ink is started, and thus the ink is ejected as appropriate onto the upper end or its vicinity of the paper (this superiority is more effective in particular in borderless printing in which printing is performed on the entire surface of the paper).

Other Embodiments

The correction method of the transport amount and the like according to the invention were described by way of the foregoing embodiment, but the foregoing embodiment of the invention is merely for the purpose of elucidating the invention and is not to be interpreted as limiting the invention. The invention can of course be altered and improved without departing from the gist thereof and equivalents are intended to be embraced therein.

In the foregoing embodiment, the inkjet printer provided with the print head for ejecting ink was described as an example of a medium transport apparatus, but the invention can be applied also to other printers such as dot impact printers and thermal transfer printers. In addition to printers, the invention can be applied to any apparatus for transporting a medium (such as color filter manufacturing apparatuses, dyeing apparatuses, fine processing apparatuses, semiconductor manufacturing apparatuses, surface processing apparatuses three-dimensional shape forming machines, liquid vaporizing apparatuses, organic EL manufacturing apparatuses (in particular, macromolecular EL manufacturing apparatuses), display manufacturing apparatuses, film formation apparatuses, and DNA chip manufacturing apparatuses).

Furthermore, in the foregoing embodiment, the transport amount when the transport roller 23 transports paper after the rotational position is specified was corrected by the controller 60 based on the rotational position information and the transporting property information in the transport amount correcting process, but there is no limitation to this. For example, the transport amount may be corrected not based on the transporting property information.

An example is conceivable in which a predetermined value $+\alpha'$ ($\alpha'$ is a positive value) is taken as the correction value if the current rotational position (the point D in FIG. 10) is at a position corresponding to 90 to 270 degrees, and a predetermined value $-\alpha'$ ($\alpha'$ is a positive value) is taken as the correction value if the current rotational position is at a position corresponding to 0 to 90 degrees or 270 to 360 degrees. However, the foregoing embodiment is preferable to this example because the foregoing embodiment enables a more exact correction to be performed.

Furthermore, in the foregoing embodiment, the rotational position of the transport roller 23 immediately before transporting paper (more specifically, the point A in FIG. 9) was specified by the controller 60, but there is no limitation to this. Alternatively, the rotational position relating to the point B or the point C in FIG. 9 may be specified.

Furthermore, in the foregoing embodiment, the graph (such as the graph in FIG. 5) indicating the relationship between the rotational position and the cumulative transport error was used as the transporting property information, which indicates a change in the actual movement amount according to the rotational position, but there is no limitation to this. For example, it is possible to use a graph indicating the relationship between the rotational position and the (non-cumulative) transport error. Moreover, it is also possible to use, not a graph indicating the relationship between the rotational position and the transport error, but a graph indicating the relationship between the rotational position and the actual movement amount, for example.

What is claimed is:

1. A correction method of a transport amount, comprising;

detecting an actual movement amount of a medium while performing transportation of the medium by a transport roller that transports the medium by rotating, wherein the actual movement amount of the medium changes in accordance with a rotational position of the rotating transport roller used in transporting the medium, and wherein the transport roller transports the medium by a predetermined transport amount according to a predetermined rotation amount of the transport roller;

specifying the rotational position of the transport roller based on the detected actual movement amount, and transporting property information of the transport roller, which indicates a change in the actual movement amount according to the rotational position of the transport roller; and correcting the predetermined transport amount by which the transport roller transports the medium, based on rotational position information, which indicates the specified rotational position.

2. A correction method of a transport amount according to claim 1, wherein the transport amount when the transport roller transports the medium after the rotational position has been specified is corrected based on the rotational position information and the transporting property information.

3. A correction method of a transport amount according to claim 1, wherein a rotational position of the transport roller immediately before transporting the medium is specified based on the detected movement amount and the transporting property information.

4. A correction method of a transport amount according to claim 1, wherein the rotational position of the transport roller is specified based on the detected movement amount and the transporting property information, and after the rotational position has been specified, ejection of ink for 35 performing printing is started.

5. A correction method of a transport amount according to claim 4, wherein the transport roller transports the medium in a predetermined transport direction by rotating, and a movement amount detecting section for detecting the movement amount of the medium is positioned on an upstream side, in the transport direction, of a print head for ejecting the ink for performing printing.

6. A medium transport apparatus, comprising:

a transport roller that transports a medium by rotating, wherein an actual movement amount of the medium changes in accordance with a rotational position of the rotating transport roller used in transporting the medium, and wherein the transport roller transports the medium by a predetermined transport amount according to a predetermined rotation amount of the transport roller;

a storing section that stores transporting property information of the transport roller, which indicates a change in the actual movement amount of the medium according to the rotational position of the transport roller;

a movement amount detecting section for detecting the actual movement amount of the medium; and a controller that causes the movement amount detecting section to detect the actual movement amount while causing the transport roller to transport the medium, that specifies the rotational position of the transport roller based on the detected actual movement amount and the transporting property information, and that corrects the predetermined transport amount by which the transport roller transports the medium, based on rotational position information, which indicates the specified rotational position.

* * * * *